US009489902B2

(12) United States Patent
Yoshida et al.

(10) Patent No.: US 9,489,902 B2
(45) Date of Patent: Nov. 8, 2016

(54) LIQUID CRYSTAL DISPLAY DEVICE

(71) Applicant: Sharp Kabushiki Kaisha, Osaka-shi, Osaka (JP)

(72) Inventors: Takehisa Yoshida, Osaka (JP); Fumikazu Shimoshikiryoh, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 58 days.

(21) Appl. No.: 14/427,344

(22) PCT Filed: Sep. 5, 2013

(86) PCT No.: PCT/JP2013/073970

§ 371 (c)(1),
(2) Date: Mar. 11, 2015

(87) PCT Pub. No.: WO2014/042073

PCT Pub. Date: Mar. 20, 2014

(65) Prior Publication Data

US 2015/0221267 A1 Aug. 6, 2015

(30) Foreign Application Priority Data

Sep. 13, 2012 (JP) ..... 2012-201917

(51) Int. Cl.
*G09G 5/02* (2006.01)
*G09G 3/36* (2006.01)

(52) U.S. Cl.
CPC ..... *G09G 3/3607* (2013.01); *G09G 3/3614* (2013.01); *G09G 3/3659* (2013.01);
(Continued)

(58) Field of Classification Search
CPC ..... G09G 3/3607; G09G 3/3614; G09G 3/3648; G09G 3/3659; G09G 2300/0447; G09G 2320/068; G09G 2320/028; G09G 2300/0452; G09G 2310/027; G09G 2300/0809; G09G 2300/0478
See application file for complete search history.

(56) References Cited

U.S. PATENT DOCUMENTS 6,958,791 B2 10/2005 Shimoshikiryo
7,079,214 B2 * 7/2006 Shimoshikiryo . G02F 1/134336 349/129

(Continued)

FOREIGN PATENT DOCUMENTS

EP 2 378 509 A1 10/2011
JP 2004-062146 A 2/2004

(Continued)

OTHER PUBLICATIONS

Kamiya, T. et al., "Present Status of Amorphous In—Ga—Zn—O Thin-Film Transistors", Science and Technology Advanced Materials 11, 2010, pp. 1-23.

*Primary Examiner* — Vijay Shankar
(74) *Attorney, Agent, or Firm* — Keating & Bennett, LLP

(57) ABSTRACT

In a liquid crystal display device (100) according to an embodiment of the present invention, a plurality of color display pixels (CP) include three or more pixels (P) which exhibit different colors. The pixels (P) include a first sub-pixel (SP1) electrically connected to a first source bus line (SA) via a first TFT (T1) and a second sub-pixel (SP2) electrically connected to a second source bus line (SB) via a second TFT (T2). The control circuit (15) is configured to generate a first display signal voltage and a second display signal voltage that are to be supplied to the first sub-pixel (SP1) and the second sub-pixel (SP2) of a pixel (P) based on a grayscale level to be exhibited by the pixel (P) and grayscale levels to be exhibited by two or more remaining pixels (P) included in a color display pixel (CP) to which the pixel (P) belongs that are indicated by an input display signal, and output the generated first and second display signal voltages to the first source bus line (SA) and the second source bus line (SB), respectively.

12 Claims, 11 Drawing Sheets

(52) U.S. Cl.
CPC .... *G09G3/3648* (2013.01); *G09G 2300/0447* (2013.01); *G09G 2300/0452* (2013.01); *G09G 2300/0478* (2013.01); *G09G 2300/0809* (2013.01); *G09G 2310/027* (2013.01); *G09G 2320/028* (2013.01); *G09G 2320/068* (2013.01)

(56) References Cited

U.S. PATENT DOCUMENTS

| | | | | |
|---|---|---|---|---|
| 7,283,192 | B2 * | 10/2007 | Shimoshikiryo | G02F 1/134336 349/129 |
| 7,982,702 | B2 * | 7/2011 | Kamada | G02F 1/133753 345/690 |
| 8,159,432 | B2 | 4/2012 | Naruse et al. | |
| 8,243,105 | B2 * | 8/2012 | Tomizawa | G09G 3/3648 345/690 |
| 2005/0122441 | A1 | 6/2005 | Shimoshikiryoh | |
| 2007/0132684 | A1 | 6/2007 | Baek et al. | |
| 2009/0189881 | A1 | 7/2009 | Ooishi et al. | |
| 2011/0157128 | A1 | 6/2011 | Koyama | |
| 2011/0175861 | A1 | 7/2011 | Wakimoto et al. | |
| 2011/0254759 | A1 | 10/2011 | Mori et al. | |
| 2012/0032942 | A1 | 2/2012 | Toyotaka et al. | |
| 2012/0138922 | A1 | 6/2012 | Yamazaki et al. | |
| 2012/0194573 | A1 | 8/2012 | Yamashita et al. | |

FOREIGN PATENT DOCUMENTS

| | | | |
|---|---|---|---|
| JP | 2007-156483 | A | 6/2007 |
| JP | 2009-175468 | A | 8/2009 |
| JP | 2011-150322 | A | 8/2011 |
| JP | 2012-53454 | A | 3/2012 |
| JP | 2012-134475 | A | 7/2012 |
| KR | 10-2011-0096176 | A | 8/2011 |
| KR | 10-2012-0068942 | A | 6/2012 |
| TW | 200537403 | A | 11/2005 |
| TW | 201137819 | A1 | 11/2011 |
| WO | 2007/034876 | A1 | 3/2007 |

* cited by examiner (a)

| | R | G | B |
|---|---|---|---|
| BRIGHT | 180 | 120 | 80 |
| DARK | 180 | 120 | 80 |

(b)

(c)

Δu'v'=0.057

| | | R | G | B |
|---|---|---|---|---|
| NORMALIZED LUMINANCE | FRONT | 0.375 | 0.150 | 0.055 |
| | OBLIQUE 60° | 0.554 | 0.440 | 0.309 |
| VIEWING ANGLE LUMINANCE RATIO (OBLIQUE/FRONT) | | 1.48 | 2.94 | 5.65 |
| RGB LUMINANCE RATIO (RELATIVE TO HIGHEST GRAYSCALE LEVEL COLOR) | FRONT | 1.00 | 0.40 | 0.15 |
| | OBLIQUE 60° | 1.00 | 0.79 | 0.56 |
| RGB LUMINANCE RATIO VARIATION (OBLIQUE-FRONT) | | 0.00 | 0.39 | 0.41 |

(a)

| | R | G | B |
|---|---|---|---|
| BRIGHT | 232 | 157 | 104 |
| DARK | 0 | 0 | 0 |

(b)

(c)

Δu'v'=0.056

| | | R | G | B |
|---|---|---|---|---|
| NORMALIZED LUMINANCE | FRONT | 0.375 | 0.150 | 0.056 |
| | OBLIQUE 60° | 0.367 | 0.265 | 0.201 |
| VIEWING ANGLE LUMINANCE RATIO (OBLIQUE/FRONT) | | 0.98 | 1.76 | 3.63 |
| RGB LUMINANCE RATIO (RELATIVE TO HIGHEST GRAYSCALE LEVEL COLOR) | FRONT | 1.00 | 0.40 | 0.15 |
| | OBLIQUE 60° | 1.00 | 0.72 | 0.55 |
| RGB LUMINANCE RATIO VARIATION (OBLIQUE-FRONT) | | 0.00 | 0.32 | 0.40 |

(a)

| | R | G | B |
|---|---|---|---|
| BRIGHT | 180 | 157 | 104 |
| DARK | 180 | 0 | 0 |

(b)

(c)

Δu'v'=0.034

| | | R | G | B |
|---|---|---|---|---|
| NORMALIZED LUMINANCE | FRONT | 0.375 | 0.150 | 0.056 |
| | OBLIQUE 60° | 0.554 | 0.265 | 0.201 |
| VIEWING ANGLE LUMINANCE RATIO (OBLIQUE/FRONT) | | 1.48 | 1.76 | 3.63 |
| RGB LUMINANCE RATIO (RELATIVE TO HIGHEST GRAYSCALE LEVEL COLOR) | FRONT | 1.00 | 0.40 | 0.15 |
| | OBLIQUE 60° | 1.00 | 0.48 | 0.36 |
| RGB LUMINANCE RATIO VARIATION (OBLIQUE-FRONT) | | 0.00 | 0.08 | 0.22 |

B: BRIGHT
D: DARK

| | No.1 | No.2 | No.3 | No.4 | No.5 | No.6 | No.7 | No.8 |
|---|---|---|---|---|---|---|---|---|
| R | A | A | A | A | B | B | B | B |
| G | A | A | B | B | A | A | B | B |
| B | A | B | A | B | A | B | A | B |

A: MULTI-PIXEL DRIVING NOT PERFORMED
B: MULTI-PIXEL DRIVING PERFORMED

| | No.1 | No.2 | No.3 | No.4 | No.5 | No.6 | No.7 | No.8 |
|---|---|---|---|---|---|---|---|---|
| R | A | A | A | A | B | B | B | B |
| G | A | A | B | B | A | A | B | B |
| B | A | B | A | B | A | B | A | B |

A: MULTI-PIXEL DRIVING NOT PERFORMED
B: MULTI-PIXEL DRIVING PERFORMED

*FIG. 11*

(a)

| R 0 | | G | | | | | | | | |
|---|---|---|---|---|---|---|---|---|---|---|
| | | 0 | 1 | 2 | 3 | 4 | | 120 | | 255 |
| B | 0 | | | | | | | | | |
| | 1 | | | | | | | | | |
| | 2 | | | | | | | | | |
| | 3 | | | | | | | | | |
| | 4 | | | | | | | | | |
| | | | | | | | | | | |
| | 80 | | | | | | | | | |
| | | | | | | | | | | |
| | 255 | | | | | | | | | |

(b)

| R 180 | | G | | | | | | | | |
|---|---|---|---|---|---|---|---|---|---|---|
| | | 0 | 1 | 2 | 3 | 4 | | 120 | | 255 |
| B | 0 | | | | | | | | | |
| | 1 | | | | | | | | | |
| | 2 | | | | | | ⋮ | | | |
| | 3 | | | | | | | | | |
| | 4 | | | | | | | | | |
| | | | | | | | | | | |
| | 80 | | | | | | | | | |
| | | | | | | | | | | |
| | 255 | | | | | | | | | |

| | BRIGHT | DARK |
|---|---|---|
| G | 157 | 0 |
| B | 104 | 0 |

(c)

| R 255 | | G | | | | | | | | |
|---|---|---|---|---|---|---|---|---|---|---|
| | | 0 | 1 | 2 | 3 | 4 | | 120 | | 255 |
| B | 0 | | | | | | | | | |
| | 1 | | | | | | | | | |
| | 2 | | | | | | | | | |
| | 3 | | | | | | | | | |
| | 4 | | | | | | | | | |
| | | | | | | | | | | |
| | 80 | | | | | | | | | |
| | | | | | | | | | | |
| | 255 | | | | | | | | | |

*FIG. 12*

| | INPUT GRAYSCALE LEVEL | | | OUTPUT GRAYSCALE LEVEL | | | | | |
|---|---|---|---|---|---|---|---|---|---|
| | | | | R | | G | | B | |
| | R | G | B | BRIGHT | DARK | BRIGHT | DARK | BRIGHT | DARK |
| | 0 | 0 | 0 | | | | | | |
| | ⋮ | ⋮ | ⋮ | | | | | | |
| | 0 | 0 | 255 | | | | | | |
| | ⋮ | ⋮ | ⋮ | | | | | | |
| | 0 | 255 | 255 | | | | | | |
| | ⋮ | ⋮ | ⋮ | | | | | | |
| EXAMPLE | 135 | 135 | 135 | 176 | 0 | 135 | 135 | 135 | 135 |
| | ⋮ | ⋮ | ⋮ | | | | | | |
| EXAMPLE | 180 | 120 | 80 | 180 | 180 | 157 | 0 | 104 | 0 |
| | ⋮ | ⋮ | ⋮ | | | | | | |
| | 255 | 255 | 255 | | | | | | |

*FIG. 13*

| INPUT GRAYSCALE LEVEL | | | OUTPUT GRAYSCALE LEVEL | | | | | | | |
|---|---|---|---|---|---|---|---|---|---|---|
| | | | R | | G | | B | | Ye | |
| R | G | B | BRIGHT | DARK | BRIGHT | DARK | BRIGHT | DARK | BRIGHT | DARK |
| 0 | 0 | 0 | | | | | | | | |
| ⋮ | ⋮ | ⋮ | | | | | | | | |
| 0 | 0 | 255 | | | | | | | | |
| ⋮ | ⋮ | ⋮ | | | | | | | | |
| 0 | 255 | 255 | | | | | | | | |
| ⋮ | ⋮ | ⋮ | | | | | | | | |
| 255 | 255 | 255 | | | | | | | | |

LIQUID CRYSTAL DISPLAY DEVICE

TECHNICAL FIELD

The present invention relates to a liquid crystal display device, and particularly to a liquid crystal display device which has excellent viewing angle characteristics.

BACKGROUND ART

Recently, vertical alignment mode (VA mode) liquid crystal display devices and transverse electric field mode liquid crystal display devices (including IPS mode devices and FFS mode devices) are used as liquid crystal display devices for TV applications and the like. Note that the transverse electric field mode is sometimes referred to as "IPS mode".

Of the above device types, the VA mode liquid crystal display device exhibits a large viewing angle dependence of the γ characteristic as compared with the IPS mode liquid crystal display device. The γ characteristic is an input grayscale level vs. luminance characteristic. In general, the viewing direction (i.e., viewing angle) is expressed by the angle with the normal to the display surface (polar angle) and the azimuthal angle that represents the azimuth in the display surface. The γ characteristic of the VA mode liquid crystal display device particularly has a large dependence on the polar angle of the viewing direction. That is, the γ characteristic that is acquired when viewed from the front (in a direction normal to the display surface) and the γ characteristic that is acquired when viewed in an oblique direction are different from each other, and therefore, the grayscale display state varies depending on the viewing direction (polar angle).

To reduce the viewing angle dependence of the γ characteristic in the VA mode liquid crystal display device, a liquid crystal display device having a multi-pixel configuration such as disclosed in Patent Document 1 of the present applicant, for example, has been put to practical use. The multi-pixel configuration refers to a configuration in which one pixel includes a plurality of sub-pixels of different brightnesses. Note that, in this specification, the "pixel" refers to the minimum unit of display in the liquid crystal display device. In the case of a color liquid crystal display device, the "pixel" refers to the minimum unit of display of each primary color (typically, R, G, or B) and is sometimes referred to as "dot".

Each of the pixels of a liquid crystal display device having a multi-pixel configuration includes a plurality of sub-pixels among which different voltages can be applied across the liquid crystal layer. For example, when a pixel displays at least an intermediate grayscale level, the pixel includes two sub-pixels which exhibit different luminances. When two sub-pixels constitute one pixel, the luminance of one of the two sub-pixels is higher than a luminance that the pixel is to display (bright sub-pixel), and the luminance of the other sub-pixel is lower than the luminance that the pixel is to display (dark sub-pixel).

The multi-pixel configuration is also referred to as "pixel-divided configuration", and various types thereof have been known. For example, each of the pixels of a liquid crystal display device shown in FIG. 1 of Patent Document 1 includes two sub-pixels, and different display signal voltages are supplied to the two sub-pixels via two source bus lines (display signal lines) respectively corresponding to the two sub-pixels. Here, this type is referred to as "source direct multi-pixel type".

On the other hand, in a liquid crystal display device shown in FIG. 12 of Patent Document 1, two sub-pixels of each pixel are supplied with equal display signal voltages. Here, as shown in FIG. 12, each sub-pixel has a storage capacitance, and a storage capacitance counter electrode (connected to the CS bus line) which forms the storage capacitance is electrically independent in each sub-pixel. The voltage supplied to the storage capacitance counter electrode ("storage capacitance counter voltage") is changed after the TFT is switched from ON to OFF, whereby effective voltages applied across the liquid crystal layer of the two sub-pixels are made different from each other with the utilization of capacitance dividing. Here, this type is referred to as "CS swing type". The CS swing type has such an advantage that the number of source bus lines can be reduced as compared with the source direct type. In the case where each pixel includes two sub-pixels as illustrated, in the CS swing type, the number of signal lines can be halved as compared with the source direct type.

Using such a multi-pixel configuration enables improving the viewing angle (particularly, polar angle) dependence of the γ characteristic of a liquid crystal display device (particularly, VA mode liquid crystal display device). However, there is such a problem that even when the viewing angle dependence of the γ characteristic is improved, the viewing angle dependence of the color reproducibility cannot be sufficiently reduced.

Patent Document 2 of the present applicant discloses a liquid crystal display device in which, for the purpose of reducing the viewing angle dependence of the color reproducibility, the area ratio and/or lighting time of the bright sub-pixel in each of the primary color pixels (typically, red (R) pixel, green (G) pixel and blue (B) pixel) is adjusted so as to reduce the viewing angle dependence of the color reproducibility of a human skin color (hereinafter, "skin color").

CITATION LIST

Patent Literature

Patent Document 1: Japanese Laid-Open Patent Publication No. 2004-62146 (Specification of U.S. Pat. No. 6,958,791)

Patent Document 2: WO 2007/034876 (Specification of U.S. Pat. No. 8,159,432)

SUMMARY OF INVENTION

Technical Problem

However, the liquid crystal display device disclosed in Patent Document 2 has such a problem that the colors of which the viewing angle dependence of the color reproducibility can be improved are limited or the driving method becomes complicated.

An object of the present invention is to provide a liquid crystal display device having a multi-pixel configuration which is capable of reducing the viewing angle dependence of the color reproducibility.

Solution to Problem

A liquid crystal display device according to an embodiment of the present invention is a liquid crystal display device including: a plurality of pixels arranged in a matrix of rows and columns; and a control circuit configured to receive an input display signal that is indicative of a grayscale level which is to be exhibited by the plurality of pixels and supply a display signal voltage to each of the plurality of pixels, wherein the plurality of pixels form a plurality of color display pixels, each of the plurality of color display pixels including three or more pixels which exhibit different colors, each of the plurality of pixels includes a first sub-pixel electrically connected to a first source bus line via a first TFT and a second sub-pixel electrically connected to a second source bus line via a second TFT, and the control circuit is configured to generate a first display signal voltage and a second display signal voltage that are to be supplied to the first sub-pixel and the second sub-pixel of an arbitrary one of the plurality of pixels based on a grayscale level to be exhibited by the arbitrary pixel and grayscale levels to be exhibited by two or more remaining pixels included in a color display pixel to which the arbitrary pixel belongs that are indicated by the input display signal, and output the generated first and second display signal voltages to the first source bus line and the second source bus line, respectively.

In one embodiment, for one grayscale level which is to be exhibited by the arbitrary pixel, the control circuit is capable of generating the first display signal voltage and the second display signal voltage that have two or more different absolute values according to the grayscale levels to be exhibited by the two or more remaining pixels. That is, even when the grayscale level exhibited by the first pixel is the same, the first display signal voltage and the second display signal voltage that are supplied to the first sub-pixel and the second sub-pixel of the first pixel can be controlled to have different absolute values according to the grayscale levels exhibited by the second pixel and the third pixel. For example, even when the grayscale level exhibited by the first pixel is the same, the grayscale level difference between sub-pixels of the first pixel can be varied between a case where the color exhibited by the color display pixel including the first, second and third pixels is a skin color and a case where the color exhibited by the color display pixel is an achromatic intermediate tone (gray).

In one embodiment, an arbitrary one of the plurality of color display pixels includes m pixels, from the $1^{st}$ pixel to the $m^{th}$ pixel, where m is an integer which is not less than 3. The grayscale levels which are to be exhibited by the $1^{st}$ pixel to the $m^{th}$ pixel are the $1^{st}$ grayscale level GL1 to the $m^{th}$ grayscale level GLm. The luminances at the front viewing angle of the $1^{st}$ pixel to the $m^{th}$ pixel achieved when the $1^{st}$ pixel to the $m^{th}$ pixel exhibit the $1^{st}$ grayscale level GL1 to the $m^{th}$ grayscale level GLm which are normalized on the assumption that the luminance at the front viewing angle achieved when the highest grayscale level is exhibited is 1 are the $1^{st}$ frontal normalized luminance NL1 to the $m^{th}$ frontal normalized luminance NLm, respectively. The luminances at the oblique 60° viewing angle of the $1^{st}$ pixel to the $m^{th}$ pixel which are normalized on the assumption that the luminance at the oblique 60° viewing angle achieved when the highest grayscale level is exhibited is 1 are the $1^{st}$ oblique viewing angle normalized luminance IL1 to the $m^{th}$ oblique viewing angle normalized luminance ILm, respectively. In this case, the control circuit is configured to generate the first display signal voltage and the second display signal voltage that are to be supplied to the first sub-pixel and the second sub-pixel of each of the $1^{st}$ pixel to the $m^{th}$ pixel such that the maximum value of the difference between the frontal luminance ratios between pixels which are obtained by normalizing the $1^{st}$ frontal normalized luminance NL1 to the $m^{th}$ frontal normalized luminance NLm with respect to the highest one of the $1^{st}$ frontal normalized luminance NL1 to the $m^{th}$ frontal normalized luminance NLm and the oblique 60° luminance ratios between pixels which are obtained by normalizing the $1^{st}$ oblique viewing angle normalized luminance IL1 to the $m^{th}$ oblique viewing angle normalized luminance ILm with respect to the highest one of the $1^{st}$ oblique viewing angle normalized luminance IL1 to the $m^{th}$ oblique viewing angle normalized luminance ILm is not more than 0.25.

In one embodiment, an arbitrary one of the plurality of color display pixels includes m pixels, from the $1^{st}$ pixel to the $m^{th}$ pixel, where m is an integer which is not less than 3. The grayscale levels which are to be exhibited by the $1^{st}$ pixel to the $m^{th}$ pixel are the $1^{st}$ grayscale level GL1 to the $m^{th}$ grayscale level GLm, respectively. The $1^{st}$ grayscale level GL1 to the $m^{th}$ grayscale level GLm include at least two different grayscale levels. In this case, the control circuit is configured to generate voltages which have equal absolute values as the first display signal voltage and the second display signal voltage respectively supplied to the first sub-pixel and the second sub-pixel of a pixel which is to exhibit a grayscale level of the largest value among the $1^{st}$ grayscale level GL1 to the $m^{th}$ grayscale level GLm.

In one embodiment, the control circuit is configured to generate the first display signal voltage and the second display signal voltage respectively supplied to the first sub-pixel and the second sub-pixel of each of the plurality of pixels exclusive of a pixel which exhibits the highest grayscale level among the m pixels included in the color display pixel such that the difference between the absolute values of the first display signal voltage and the second display signal voltage is the maximum.

For example, when the color exhibited by the color display pixel is a skin color, the relationship of "the grayscale level of the red pixel>the grayscale level of the green pixel>the grayscale level of the blue pixel" holds. Therefore, the grayscale level difference between sub-pixels of the red pixel is set to zero, while the grayscale level differences between sub-pixels of the green pixel and the blue pixel are each set to the maximum value.

When the color exhibited by the color display pixel is an achromatic intermediate tone, for example, the grayscale level differences between sub-pixels of the blue pixel and the green pixel are each set to zero, while the grayscale level difference between sub-pixels of the red pixel is set to the maximum value.

In one embodiment, the first source bus line and the second source bus line extend in the column direction, in each of the plurality of pixels, the first sub-pixel and the second sub-pixel are arranged in the column direction, and a polarity of the first display signal voltage supplied from the first source bus line and a polarity of the second display signal voltage supplied from the second source bus line are each constant within a frame.

In one embodiment, the polarity of the first display signal voltage supplied from the first source bus line and the polarity of the second display signal voltage supplied from the second source bus line are opposite to each other in a frame.

In one embodiment, some of the plurality of pixels which are arranged in the column direction are to exhibit a same color, and two sub-pixels which belong to two pixels adjacent to each other in the column direction and which are electrically connected to the first source bus line are adjacent to each other in the column direction.

In one embodiment, each of the plurality of color display pixels includes a red pixel, a green pixel, and a blue pixel.

In one embodiment, each of the plurality of color display pixels further includes a yellow pixel. The color display pixel may include a white pixel instead of the yellow pixel. Further, each of the plurality of color display pixels may include a red pixel, a green pixel, a blue pixel, a cyan pixel, a magenta pixel, and a yellow pixel.

In one embodiment, the first TFT and the second TFT include a semiconductor oxide layer as an active layer. The semiconductor oxide layer includes IGZO.

Advantageous Effects of Invention

According to an embodiment of the present invention, a liquid crystal display device having a multi-pixel configuration is provided which is capable of reducing the viewing angle dependence of the color reproducibility.

The liquid crystal display device of the embodiment of the present invention has such a configuration that the amplitude of display signal voltages that are to be supplied to two sub-pixels included in each pixel can be arbitrarily controlled. In each pixel, the grayscale level difference between sub-pixels is controlled according to the color exhibited by the color display pixel. Therefore, the grayscale level difference between sub-pixels in each pixel can be controlled according to the color exhibited by the color display pixel such that the viewing angle dependence of the color reproducibility is reduced.

BRIEF DESCRIPTION OF DRAWINGS

FIG. 11 (*a*) to (*c*) show examples of a look-up table used for generation of display signal voltages supplied to two sub-pixels in a liquid crystal display device of an embodiment of the present invention.

FIG. 12 Another example of the look-up table used for generation of display signal voltages supplied to two sub-pixels in a liquid crystal display device of an embodiment of the present invention.

FIG. 13 Still another example of the look-up table used for generation of display signal voltages supplied to two sub-pixels in a liquid crystal display device of an embodiment of the present invention.

DESCRIPTION OF EMBODIMENTS

Hereinafter, a liquid crystal display device and a driving method thereof according to an embodiment of the present invention will be described with reference to the drawings. Note that the embodiment of the present invention is not limited to embodiments that will be described below.

Figure 1:
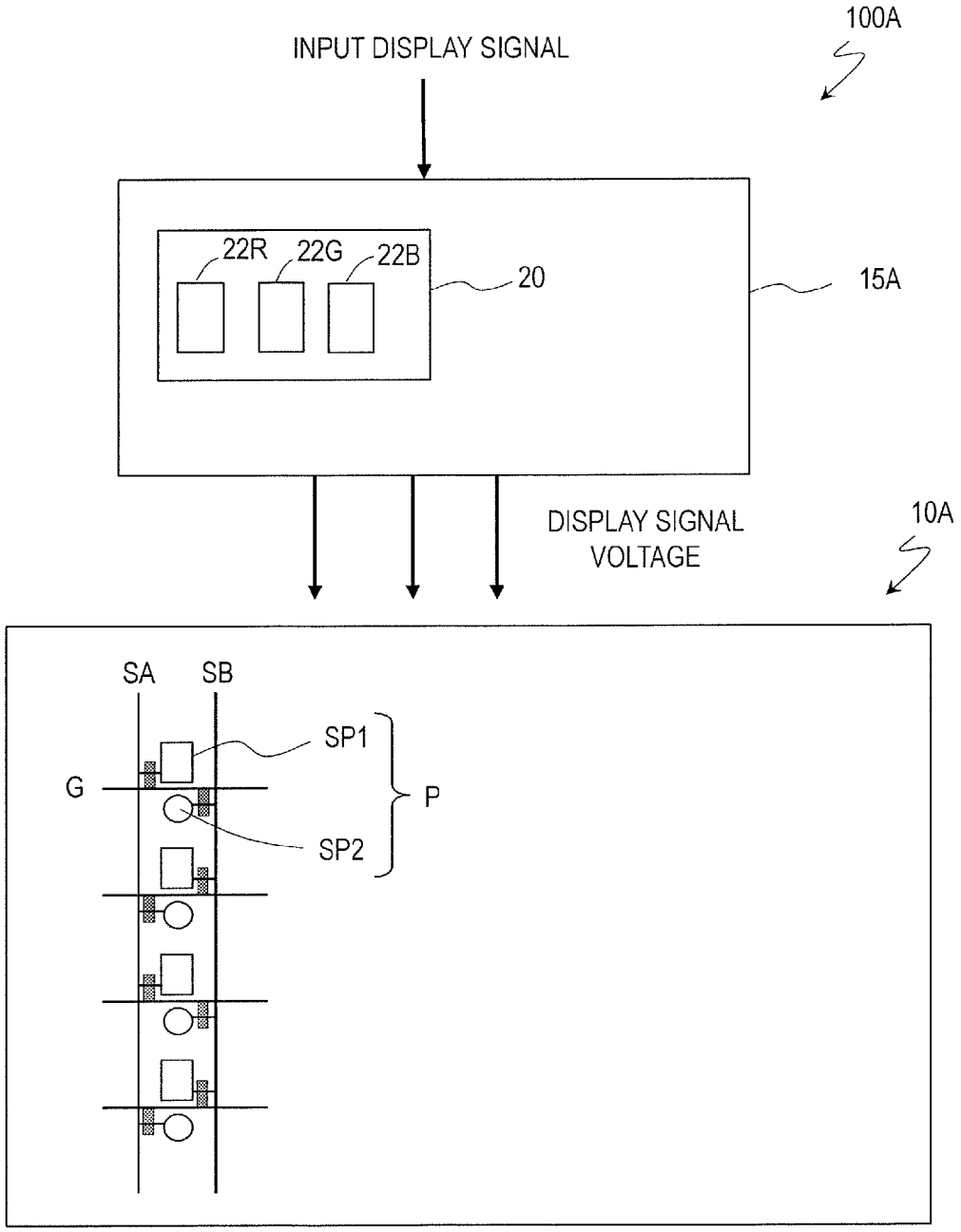
FIG. 1 A schematic diagram of a liquid crystal display device 100 according to an embodiment of the present invention.

As shown in FIG. 1, a liquid crystal display device 100 according to an embodiment of the present invention includes a liquid crystal display panel 10 which has a plurality of pixels P arranged in a matrix of rows and columns and a control circuit 15 configured to receive input display signals that are indicative of grayscale levels which are to be exhibited by the plurality of pixels P and supply display signal voltages to respective ones of the plurality of pixels P. A part or the entirety of the control circuit 15 may be formed integrally with the liquid crystal display panel 10.

Each of the pixels P includes a first sub-pixel SP1 and a second sub-pixel SP2. The first sub-pixel SP1 is supplied with a first display signal voltage from the first source bus line SA. The second sub-pixel SP2 is supplied with a second display signal voltage from the second source bus line SB. The first display signal voltage and the second display signal voltage can be arbitrary voltages because they are supplied from two source bus lines SA and SB which are electrically independent of each other.

The liquid crystal display device 100 is a VA mode liquid crystal display device which operates in the normally-black mode. When the liquid crystal display device 100 displays at least an intermediate grayscale level, the first display signal voltage and the second display signal voltage are made different from each other, whereby the grayscale levels exhibited by the first sub-pixel SP1 and the second sub-pixel SP2 are also made different from each other. Multi-pixel driving may be performed only when the intermediate grayscale level is lower than the grayscale level of 96/255 of the grayscale (the $96^{th}$ grayscale level in the 256-level representation (from 0 to 255)).

Note that, herein, the "intermediate grayscale level" does not include any of the highest grayscale level (white) and the lowest grayscale level (black). When a pixel consists of only two sub-pixels, a grayscale level which is to be exhibited by the pixel is exhibited by the two sub-pixels. Therefore, the grayscale level exhibited by one of the sub-pixels is higher than a grayscale level to be exhibited by a pixel which is indicated by the input display signal (bright sub-pixel) and the grayscale level exhibited by the other sub-pixel is lower than the grayscale level to be exhibited by the pixel (dark sub-pixel). In this case, there are a plurality of combinations of the grayscale levels exhibited by the two sub-pixels. As the difference between the grayscale levels exhibited by the two sub-pixels (hereinafter, sometimes simply referred to as "grayscale level difference between sub-pixels") increases, the effect of improving the γ characteristic also increases. When the multi-pixel driving is not performed, the grayscale levels exhibited by the two sub-pixels are equal to the grayscale level exhibited by the pixel.

Next, the configuration of the liquid crystal display panel 10 is described with reference to FIG. 2.

The plurality of pixels P of the liquid crystal display panel 10 form a plurality of color display pixels CP. Each of the plurality of color display pixels CP includes three or more pixels P which exhibit different colors. In the example described in this section, each of the color display pixels CP consists of a red pixel (R pixel), a green pixel (G pixel) and a blue pixel (B pixel). Also, another example is described in which the pixels P of respective colors are in a stripe arrangement.

The pixels P in a matrix arrangement are identified by the row number and the column number. For example, a pixel P in the $m^{th}$ row and the $n^{th}$ column is expressed as P(m, n). For example, a pixel column Pn which is the $n^{th}$ column is red (R), a pixel column Pn+1 which is the $n+1^{th}$ column is green (G), and a pixel column Pn+2 which is the $n+2^{th}$ column is blue (B). Three consecutive pixels P arranged one after another in the row direction, for example, P(m, n), P(m, n+1) and P(m, n+2) in a pixel row Pm that is the $m^{th}$ row, constitute one color display pixel CP.

Each of the plurality of pixels P includes a first sub-pixel SP1 which is electrically connected to the first source bus line SA via the first TFT T1 and a second sub-pixel SP2 which is electrically connected to the second source bus line SB via the second TFT T2. The first TFT T1 and the second TFT T2 are, for example, configured so as to be connected to a common gate bus line G and supplied with a common scan signal as described in this section, although the present invention is not limited to this example. Scan signals may be supplied from different gate bus lines G. During a period in which the first TFT T1 and the second TFT T2 are kept ON by the scan signals, the first and second display signal voltages are supplied to the first and second sub-pixels SP1 and SP2 from the first and second source bus lines SA and SB, respectively. From the viewpoint of thus supplying display signal voltages from the two source bus lines SA and SB to one pixel P, high TFT driving performance is preferred. The first TFT T1 and the second TFT T2 are realized by, for example, TFTs which include a semiconductor oxide layer as the active layer.

The semiconductor oxide layer includes, for example, IGZO. Here, IGZO is an oxide of In (indium), Ga (gallium) and Zn (zinc) and include a wide variety of In—Ga—Zn—O oxides. IGZO may be amorphous or may be crystalline. A preferred crystalline IGZO layer is a crystalline IGZO layer whose c-axis is oriented generally perpendicular to the layer surface. The crystalline structure of such an IGZO layer is disclosed in, for example, Japanese Laid-Open Patent Publication No. 2012-134475. The entire disclosures of Japanese Laid-Open Patent Publication No. 2012-134475 are herein incorporated by reference.

The control circuit 15 of the liquid crystal display device 100 includes a bright/dark division control circuit 20 as shown in FIG. 1. The bright/dark division control circuit 20 includes, for example, primary color bright/dark division control circuits 22R, 22G and 22B for respective ones of the primary colors (here, respective ones of R, G and B). The control circuit 15 that includes the bright/dark division control circuit 20 is configured to generate a first display signal voltage and a second display signal voltage which are to be supplied to the first sub-pixel SP1 and the second sub-pixel SP2 of an arbitrary one of the pixels P based on a grayscale level to be exhibited by the arbitrary pixel P and grayscale levels to be exhibited by the two or more remaining pixels P included in a color display pixel CP to which the arbitrary pixel P belongs that are indicated by the input display signal, and output the generated first and second display signal voltages to the first source bus line SA and the second source bus line SB, respectively. That is, for one grayscale level which is to be exhibited by the arbitrary pixel P, the control circuit 15 is capable of generating the first display signal voltage and the second display signal voltage that have two or more different absolute values according to the grayscale levels to be exhibited by the two or more remaining pixels included in a color display pixel CP to which the arbitrary pixel P belongs. Therefore, for example, in the case where a color display pixel includes the first pixel (e.g., R pixel), the second pixel (e.g., G pixel) and the third pixel (e.g., B pixel) which exhibit different colors from one another, even when the grayscale level exhibited by the first pixel (R pixel) is the same, the first display signal voltage and the second display signal voltage that are supplied to the first sub-pixel and the second sub-pixel of the first pixel can be controlled to have different absolute values according to the grayscale levels exhibited by the second pixel and the third pixel. For example, as will be described later with a specific example, even when the grayscale level exhibited by the R pixel is the same, the grayscale level difference between sub-pixels of the R pixel can be varied between a case where the color exhibited by the color display pixel is a skin color and a case where the color exhibited by the color display pixel is an achromatic intermediate tone (gray).

Note that, in general, the control circuit 15 includes a timing control circuit, a gate bus line (scan line) driving circuit, a source bus line (signal line) driving circuit, etc., although these components are herein omitted for the sake of simplicity.

Figure 3:
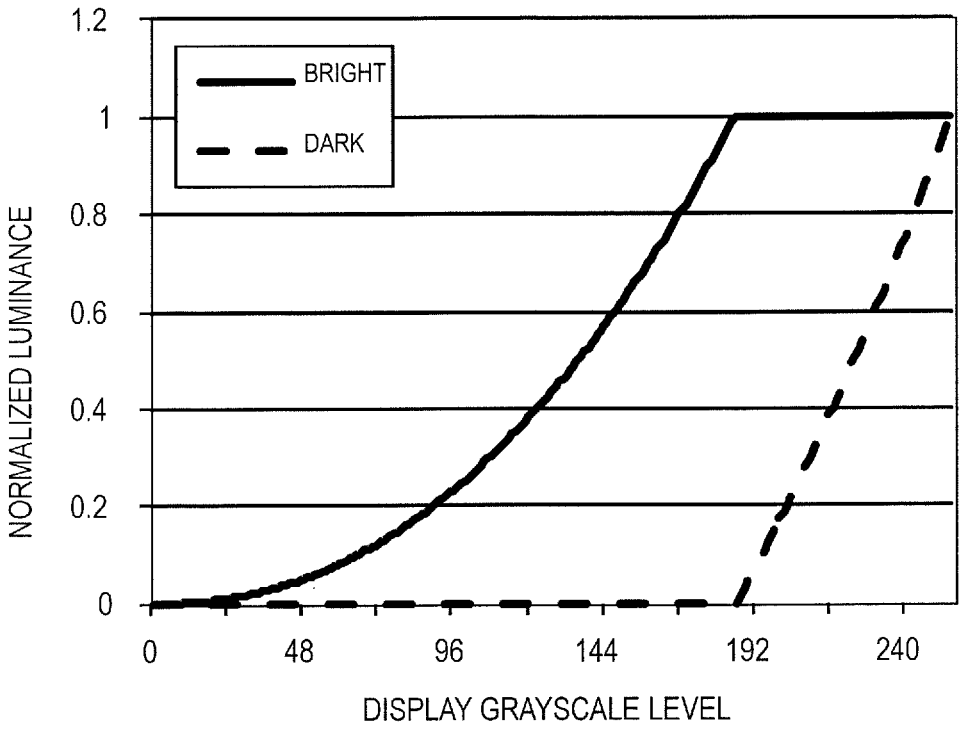
FIG. 3 A graph showing the relationship between the display grayscale level and the normalized luminance of the bright sub-pixel and the dark sub-pixel when multi-pixel driving is performed.

FIG. 3 is a graph showing the relationship between the display grayscale levels of the bright sub-pixel and the dark sub-pixel and the normalized luminance when the multi-pixel driving is performed. FIG. 3 is exemplary. In FIG. 3, the horizontal axis represents the display grayscale level which is to be displayed by a pixel (from 0 to 255), and the vertical axis represents the luminances exhibited by the two sub-pixels which are normalized on the assumption that the maximum value is 1. Note that in the example described herein, the area ratio of the bright sub-pixel and the dark sub-pixel is 1:1.

As the difference in normalized luminance between the bright sub-pixel and the dark sub-pixel (the difference in grayscale level converted from the luminance is the grayscale level difference between sub-pixels) increases, the effect of reducing the viewing angle dependence of the γ characteristic improves. Therefore, as illustrated in FIG. 3, it is preferred that the normalized luminance of the dark sub-pixel is 0.00 (the display grayscale level is 0) so long as it is possible. If a desired display grayscale level of a pixel is not achieved in the case where the normalized luminance of the bright sub-pixel is the maximum (i.e., 1.00 (the display grayscale level is 255)) and the normalized luminance of the dark sub-pixel is 0.00 (the display grayscale level is 0), the first and second display signal voltages are preferably generated such that the normalized luminance of the dark sub-pixel exceeds 0.00. Now, consider a case where the area ratio of the bright sub-pixel and the dark sub-pixel is 1:1 as shown in FIG. 3. When the display grayscale level of the pixel is in the range from the lowest grayscale level (0/255=black) to 186/255, only the display grayscale level of the bright sub-pixel increases while the display grayscale level of the dark sub-pixel is 0. When the display grayscale level of the pixel is in the range from 187/255 to the highest grayscale level (255/255=white), only the display grayscale level of the dark sub-pixel increases while the display grayscale level of the bright sub-pixel is constant (saturated) at 255/255.

Next, the viewing angle dependence of the γ characteristic and the viewing angle dependence of the color reproducibility which are attributed to the multi-pixel driving are described with reference to FIG. 4 to FIG. 6.

Figure 4:
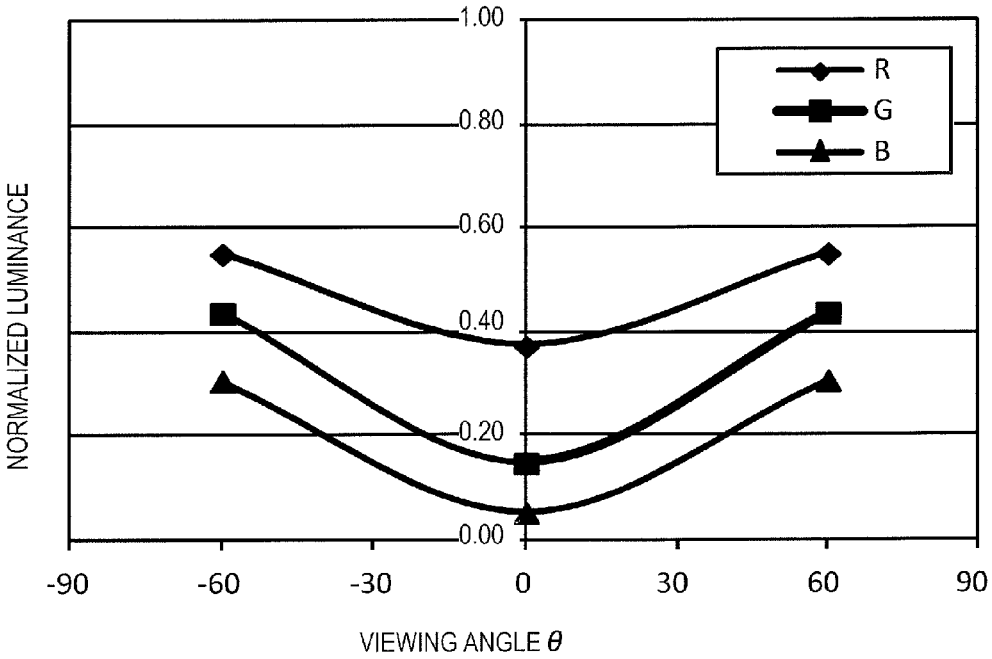
FIG. 4 (*a*) to (*c*) are charts for illustrating the display characteristics achieved when multi-pixel driving is not performed.

FIGS. 4(*a*) to 4(*c*) are charts for illustrating the display characteristics achieved when the multi-pixel driving is not performed. FIGS. 5(*a*) to 5(*c*) are charts for illustrating the display characteristics achieved when conventional multi-pixel driving is performed. FIGS. 6(*a*) to 6(*c*) are charts for illustrating the display characteristics achieved when the multi-pixel driving of an embodiment of the present invention is performed. In the example described herein, the grayscale levels which are to be displayed by the R pixel, the G pixel and the B pixel are 180/255, 120/255 and 80/255, respectively.

Firstly, when the multi-pixel driving is not performed, the grayscale levels which are to be exhibited by the bright sub-pixel and the dark sub-pixel of each of the R, G and B pixels are equal to the grayscale levels which are to be exhibited by respective ones of the R, G and B pixels as shown in FIG. 4(*a*). The viewing angle dependences of the normalized luminances of respective ones of the pixels which are achieved in this case are shown in FIG. 4(*b*). The viewing angle dependences shown in FIG. 4(*b*) represent the dependence on the polar angle θ (angle with the normal to the display surface) in the azimuthal angle 0° or 180° (horizontal direction of the display surface). Here, the polar angle θ is sometimes referred to as "viewing angle θ". The same applies to FIG. 5(*b*) and FIG. 6(*b*).

As seen from FIG. 4(*b*), as the viewing angle θ (absolute value) increases, the normalized luminances of all the R, G and B pixels increase. Such a phenomenon that the luminance increases as the viewing angle is slanted to an oblique direction is called "whitening". The displayed color appears whitish.

This phenomenon can be quantitatively evaluated by using, for example, the parameters shown in FIG. 4(*c*).

FIG. 4(*c*) shows, for each of the R, G and B pixels, the normalized luminance acquired when viewed from the front, the normalized luminance acquired when viewed at an oblique viewing angle of polar angle 60°, and the viewing angle luminance ratio (oblique/front) that is calculated by dividing the normalized luminance acquired when viewed at an oblique viewing angle of polar angle 60° by the normalized luminance acquired when viewed from the front. FIG. 4(*c*) further shows, for each of the R, G and B pixels, values of the normalized luminance acquired when viewed from the front and the normalized luminance acquired when viewed at an oblique viewing angle of polar angle 60° which are normalized on the assumption that the normalized luminance of the R pixel in which the grayscale level to be displayed is the highest among the R, G and B pixels is 1.00 (RGB luminance ratio (also referred to as "luminance ratio between pixels")), and the values calculated by subtracting the RGB luminance ratio obtained when viewed from the front from the RGB luminance ratio obtained when viewed at an oblique viewing angle of polar angle 60° (RGB luminance ratio variation (oblique-front)). The value of the RGB luminance ratio variation (oblique-front) is a parameter which represents the color shift at the oblique viewing angle.

The viewing angle luminance ratios (oblique/front) of the R, G and B pixels are 1.48, 2.94 and 5.65, respectively, as shown in FIG. 4(*c*). In each of these pixels, it is seen that, the normalized luminance at the oblique 60° viewing angle is greater than the normalized luminance at the front viewing angle so that the displayed color appears whitish. Note that the magnitude of the increase in luminance at the oblique viewing angle (viewing angle luminance variation) is greater in the G pixel that is to display the grayscale level of 120/255 (2.94) than in the R pixel that is to display the grayscale level of 180/255 (1.48), and is greater in the B pixel that is to display the grayscale level of 80/255 (5.65) than in the G pixel that is to display the grayscale level of 120/255. The RGB luminance ratio (luminance ratio between pixels) relative to the highest grayscale level color is R pixel:G pixel:B pixel=1.00:0.40:0.15 when viewed from the front (i.e., when the color which is to be displayed is displayed). On the other hand, when viewed obliquely at 60°, R pixel:G pixel:B pixel=1.00:0.79:0.56, and it is seen that the luminances of the G pixel and the B pixel are excessively large.

The difference in the viewing angle dependence of the color reproducibility can be quantitatively evaluated by the value of the RGB luminance ratio variation (oblique-front) relative to the highest grayscale level color of FIG. 4(*c*). As shown in FIG. 4(*c*), the values of the RGB luminance ratio variation (oblique-front) relative to the highest grayscale level color are 0.00 for the R pixel that is to exhibit the highest grayscale level color and 0.39 and 0.41 for the G pixel and the B pixel, respectively. That is, it is seen that, as compared with the increase of the luminance of the R pixel that is to display the highest grayscale level among the three pixels (here, 180/255), the magnitude of the increases in luminance of the G pixel and the B pixel that are to display lower grayscale levels are large, and the magnitude of the increase in luminance of the B pixel that is to display a lower grayscale level than the G pixel is the largest. Thus, it is seen that the magnitude of the increase in luminance of a pixel due to slanting of the viewing angle depends on the grayscale level to be displayed, and as a result, the color reproducibility depends on the viewing angle.

The difference between a color perceived when viewed at the front viewing angle and a color perceived when viewed at the 60° oblique viewing angle is herein expressed by the value of the distance (Δu'v') between the u'v' coordinates in the CIE1976 UCS chromaticity diagram (hereinafter, sometimes simply referred to as "color difference"). In the case where the color to be displayed by the color display pixel is R,G,B=180,120,80, Δu'v'=0.057 when the multi-pixel driving is not performed.

Figure 5:
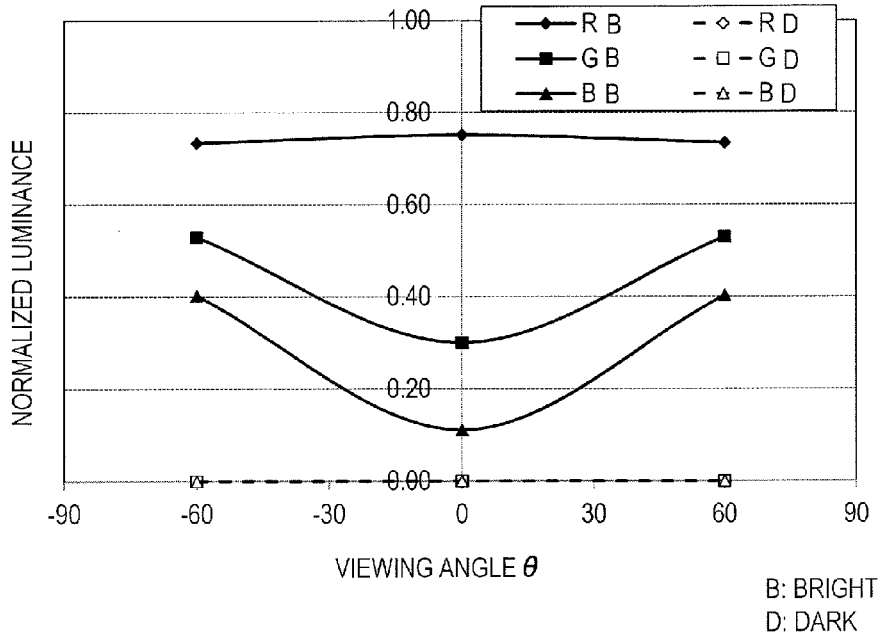
FIG. 5 (*a*) to (*c*) are charts for illustrating the display characteristics achieved when conventional multi-pixel driving is performed.

Next, as shown in FIG. 5(*a*), to reduce the viewing angle dependence of the γ characteristic, the grayscale levels which are to be exhibited by the bright sub-pixel and the dark sub-pixel are set, and the multi-pixel driving is performed. For the purpose of maximizing the effect of the multi-pixel driving, the grayscale level which is to be exhibited by each of the dark sub-pixels of the R, G and B pixels is set to 0 while the grayscale levels which are to be exhibited by the bright sub-pixels of the R, G and B pixels are 232, 157 and 104, respectively.

As shown in FIG. 5(*b*), the luminance of the dark sub-pixel of each pixel is 0.00, so that it does not depend on the viewing angle. On the other hand, it is seen that the viewing angle dependence of the luminance of the bright sub-pixel of each pixel is small as compared with FIG. 4(*b*). In this case, the viewing angle luminance ratios (oblique/front) of the R, G and B pixels are 0.98, 1.76 and 3.63, respectively, as shown in FIG. 5(*c*). It is seen that these values are smaller than 1.48, 2.94 and 5.65 shown in FIG. 4(*c*). Thus, a variation in luminance due to the viewing angle is suppressed by the multi-pixel driving.

However, the RGB luminance ratio relative to the highest grayscale level color which is achieved when viewed obliquely at 60° is R pixel:G pixel:B pixel=1.00:0.72:0.55 as shown in FIG. 5(*c*). That is, the improvement over the RGB luminance ratio which is achieved when the multi-pixel driving is not performed such as shown in FIG. 4(*c*), R pixel:G pixel:B pixel=1.00:0.79:0.56, is small. The values of the RGB luminance ratio variation (oblique-front) relative to the highest grayscale level color which are shown in FIG. 5(*c*) are 0.32 and 0.40 for the G pixel and the B pixel, respectively. Although these values are slightly smaller than the values of the RGB luminance ratio variation (oblique-front) shown in FIG. 4(*c*) (0.39 and 0.41), the increase in luminance of the G pixel and the B pixel which are to exhibit different colors from the highest grayscale level color is large, and it cannot be said that the viewing angle dependence of the color reproducibility is suppressed. In this case, $\Delta u'v'=0.056$. The difference of this value from 0.057 that is achieved when the multi-pixel driving is not performed is small.

In the multi-pixel driving, the liquid crystal display device 100 according to an embodiment of the present invention is configured to set the grayscale level difference between two sub-pixels according to the grayscale levels to be exhibited by the remaining two or more pixels included in a color display pixel CP to which the pixel P belongs, rather than maximizing the difference between the grayscale levels which are to be exhibited by the two sub-pixels. Note that, in some cases, the grayscale level difference is set to 0 depending on the color exhibited by the color display pixel and the colors of the pixels.

Figure 6:
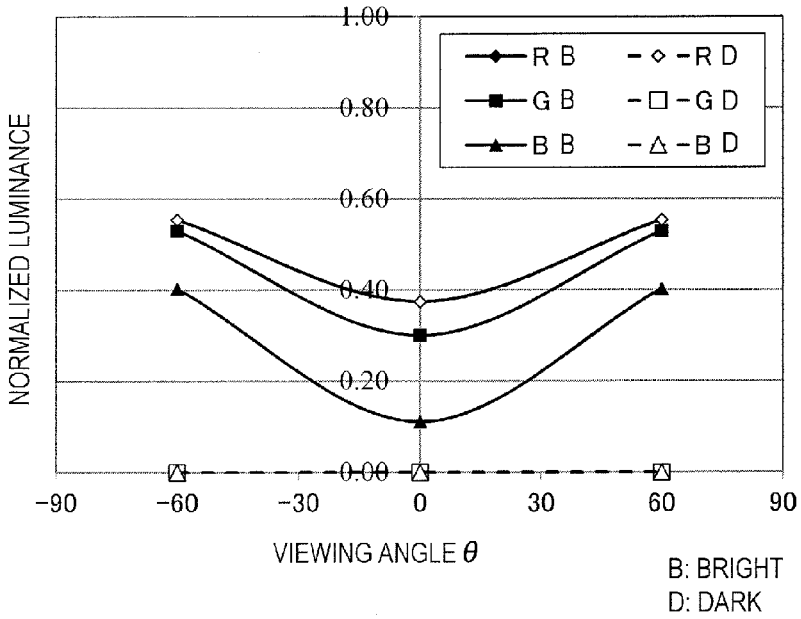
FIG. 6 (*a*) to (*c*) are charts for illustrating the display characteristics achieved when multi-pixel driving of an embodiment of the present invention is performed.

In this example, as shown in FIG. 6(*a*), the multi-pixel driving is not performed for the R pixel which is to exhibit the highest grayscale level. That is, the grayscale level difference between sub-pixels is zero for the R pixel, while the grayscale level difference between sub-pixels for each of the G pixel and the B pixel is set to the maximum value similarly as in the example of FIG. 5(*a*).

Accordingly, as shown in FIG. 6(*b*), the viewing angle dependence of the R pixel is equal to the viewing angle dependence of the R pixel of FIG. 4(*b*), and the viewing angle dependences of the G pixel and the B pixel are equal to the viewing angle dependences of the G pixel and the B pixel of FIG. 5(*b*). Therefore, as shown in FIG. 6(*c*), the viewing angle luminance ratios (oblique/front) of the R, G and B pixels are 1.48, 1.76 and 3.63, respectively.

In that case, the RGB luminance ratio (the luminance ratio between pixels) relative to the highest grayscale level color which is achieved when viewed obliquely at 60° is R pixel:G pixel:B pixel=1.00:0.48:0.36 as shown in FIG. 6(*c*). It is seen that this value shows an improvement over R pixel:G pixel:B pixel=1.00:0.72:0.55 of FIG. 5(*c*). The values of the RGB luminance ratio variation (oblique-front) of the G pixel and the B pixel relative to the highest grayscale level color are 0.08 and 0.22, respectively, and as clearly seen from the comparison with the values of the RGB luminance ratio variation (oblique-front) shown in FIG. 5(*c*) (0.32 and 0.40), the viewing angle dependence of the color reproducibility is suppressed. In this case, $\Delta u'v'=0.034$, which is significantly smaller than 0.056 that is achieved when the conventional multi-pixel driving is performed. Thus, the liquid crystal display device 100 of the embodiment of the present invention is capable of reducing the viewing angle dependence of the color reproducibility.

Although in the example described herein the color display pixel consists of R, G and B pixels, the color display pixel may further include a yellow pixel (Ye pixel). Alternatively, the color display pixel may include a white pixel instead of the yellow pixel. Further, each of the plurality of color display pixels may include a red pixel, a green pixel, a blue pixel, a cyan pixel, a magenta pixel, and a yellow pixel.

According to an embodiment of the present invention, when the color display pixel consisting of the R, G and B pixels which has been described in the above example is used to display the grayscale level of 180/255 in the R pixel, 120/255 in the G pixel and 80/255 in the B pixel, the maximum value of the RGB luminance ratio variation (oblique-front) relative to the highest grayscale level color is 0.22. This value is considerably smaller than the maximum value of the RGB luminance ratio variation (oblique-front) relative to the highest grayscale level color in the conventional multi-pixel driving, 0.40. Although, as a matter of course, it is more preferred that the maximum value of the RGB luminance ratio variation (oblique-front) relative to the highest grayscale level color has a smaller value, the effect of reducing the viewing angle dependence of the color reproducibility is achieved so long as it is smaller than the maximum value of the RGB luminance ratio variation (oblique-front) relative to the highest grayscale level color in the conventional multi-pixel driving. It is preferred that the maximum value of the RGB luminance ratio variation (oblique-front) relative to the highest grayscale level color is not more than 0.25.

Generalizing the above discussion into a case where the color display pixel includes m pixels, the following description is possible. Here, an arbitrary one of the color display pixels includes m pixels, from the $1^{st}$ pixel to the $m^{th}$ pixel, where m is an integer which is not less than 3. The grayscale levels which are to be exhibited by the $1^{st}$ pixel to the $m^{th}$ pixel are the $1^{st}$ grayscale level GL1 to the $m^{th}$ grayscale level GLm. The luminances at the front viewing angle of the $1^{st}$ pixel to the $m^{th}$ pixel achieved when the $1^{st}$ pixel to the $m^{th}$ pixel exhibit the $1^{st}$ grayscale level GL1 to the $m^{th}$ grayscale level GLm which are normalized on the assumption that the luminance at the front viewing angle achieved when the highest grayscale level is exhibited is 1 are the $1^{st}$ frontal normalized luminance NL1 to the $m^{th}$ frontal normalized luminance NLm, respectively. The luminances at the oblique 60° viewing angle of the $1^{st}$ pixel to the $m^{th}$ pixel which are normalized on the assumption that the luminance at the oblique 60° viewing angle achieved when the highest grayscale level is exhibited is 1 are the $1^{st}$ oblique viewing angle normalized luminance IL1 to the $m^{th}$ oblique viewing angle normalized luminance ILm, respectively. In this case, according to an embodiment, the control circuit 15 is configured to generate the first display signal voltage and the second display signal voltage that are to be supplied to the first sub-pixel and the second sub-pixel of each of the $1^{st}$ pixel to the $m^{th}$ pixel such that the maximum value of the difference between the frontal luminance ratios between pixels which are obtained by normalizing the $1^{st}$ frontal normalized luminance NL1 to the $m^{th}$ frontal normalized luminance NLm with respect to the highest one of the $1^{st}$ frontal normalized luminance NL1 to the $m^{th}$ frontal normalized luminance NLm and the oblique 60° luminance ratios between pixels which are obtained by normalizing the $1^{st}$ oblique viewing angle normalized luminance IL1 to the $m^{th}$ oblique viewing angle normalized luminance ILm with respect to the highest one of the $1^{st}$ oblique viewing angle normalized luminance IL1 to the $m^{th}$ oblique viewing angle normalized luminance ILm is not more than 0.25.

Next, connections of the pixel P and sub-pixels SP1, SP2 with the first source bus line SA and the second source bus line SB in the liquid crystal display panel 10 and the waveforms of the first display signal voltage and the second display signal voltage that are supplied to the first source bus line SA and the second source bus line SB, respectively, are described with reference to FIG. 2 and FIG. 7.

Figure 2:
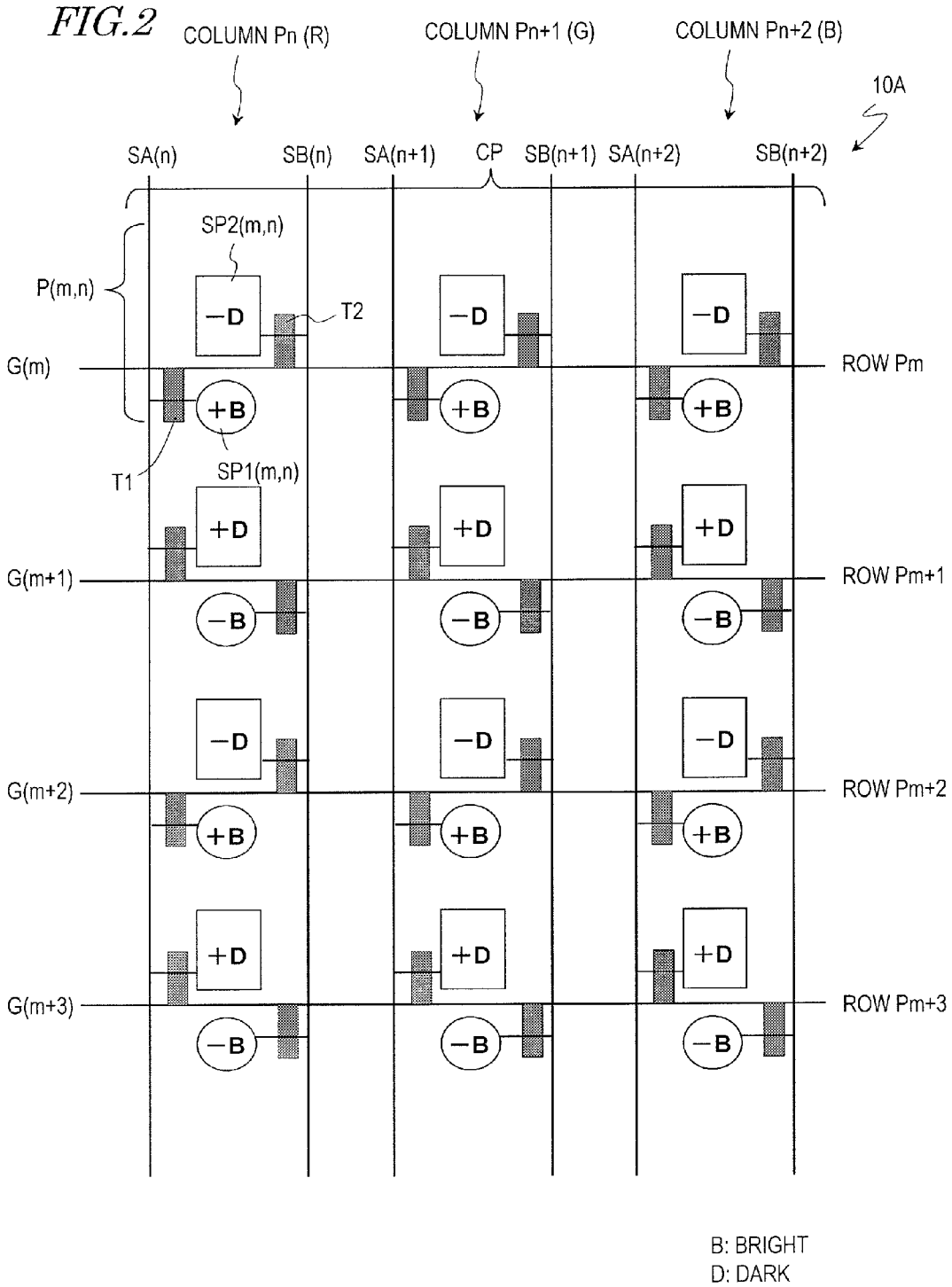
FIG. 2 A schematic diagram of a liquid crystal display panel 10 included in the liquid crystal display device 100.

As shown in FIG. 2, the first source bus line SA and the second source bus line SB extend in the column direction. In each of the plurality of pixels P, the first sub-pixel SP1 and the second sub-pixel SP2 are arranged in the column direction. As described above, some of the pixels P arranged in the column direction are to exhibit the same color. Two sub-pixels which belong to two pixels P adjacent to each other in the column direction and which are electrically connected to the first source bus line SA are adjacent to each other in the column direction. For example, the sub-pixel SP1 of the pixel P(m, n) and the sub-pixel SP2 of the pixel P(m+1, n) are both electrically connected to the first source bus line SA via the first TFT T1 and are adjacent to each other.

Figure 7:
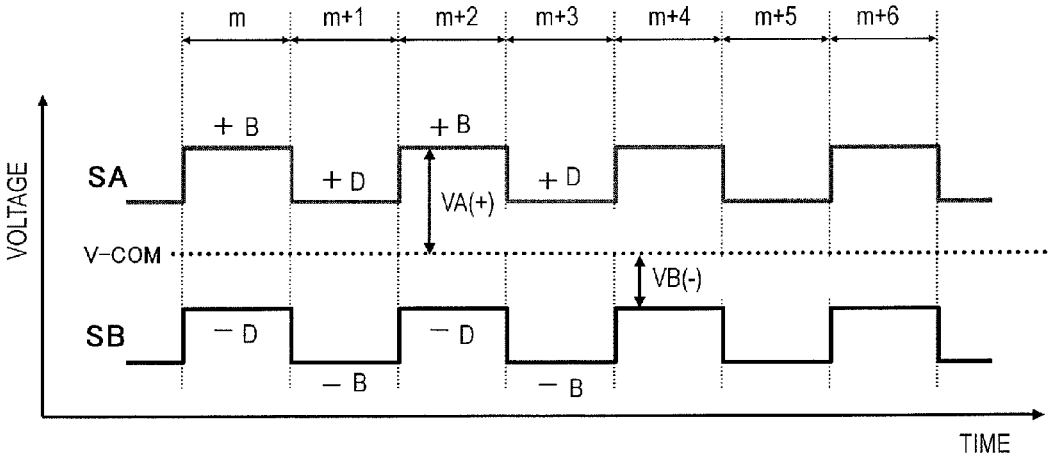
FIG. 7 A graph showing the waveforms of display signal voltages supplied to two sub-pixels.

FIG. 7 shows an example of the waveforms of the first display signal voltage supplied to the first source bus line SA and the second display signal voltage supplied to the second source bus line SB.

As shown in FIG. 7, the polarity of the first display signal voltage supplied from the first source bus line SA and the polarity of the second display signal voltage supplied from the second source bus line SB are each constant within a frame. The polarity of the first display signal voltage supplied from the first source bus line SA and the polarity of the second display signal voltage supplied from the second source bus line SB are opposite to each other in a frame. Here, the "frame" means a period between selection of a gate bus line (scan line) and the next selection of the same gate bus line, and is also sometimes referred to as "one vertical scan period". The polarity of the first display signal voltage and the polarity of the second display signal voltage are inverted every frame or every two or more frames. Inversion of the polarity with intervals which are equal to or longer than the frame period can be appropriately set such that a DC voltage is not applied across the liquid crystal layer in a long drive operation.

When the first and second display signal voltages shown in FIG. 7 are supplied to the liquid crystal display panel 10 that has the configuration shown in FIG. 2, the interval of polarity inversion of the display signal voltages is one frame, and dot inversion is realized in every frame. Therefore, the display quality can be improved while the power consumption is suppressed. In this case, for example, when pixels of one pixel column exhibit an intermediate grayscale level and a grayscale level difference between sub-pixels is given to form bright sub-pixels and dark sub-pixels, bright sub-pixels which are electrically connected to the first source bus line SA and bright sub-pixels which are electrically connected to the second source bus line SB alternately occur in the pixel column.

In this case, the first display signal voltage and the second display signal voltage are oscillating voltages whose amplitudes vary every horizontal scan period (sometimes referred to as "1H"). The period of the oscillation is 2H. That is, in each of the first display signal voltage and the second display signal voltage, the amplitude for the bright sub-pixel and the amplitude for the dark sub-pixel occur alternately every horizontal scan period. Note that the largeness (amplitude) of a display signal voltage refers to a largeness (amplitude) of the display signal voltage measured relative to the counter voltage (also referred to as "common voltage"). Note that one horizontal scan period refers to the difference (period) between a time of selection of one gate bus line (e.g., $m^{th}$ gate bus line) and a time of selection of the next gate bus line (e.g., $m+1^{th}$ gate bus line).

Figure 8:
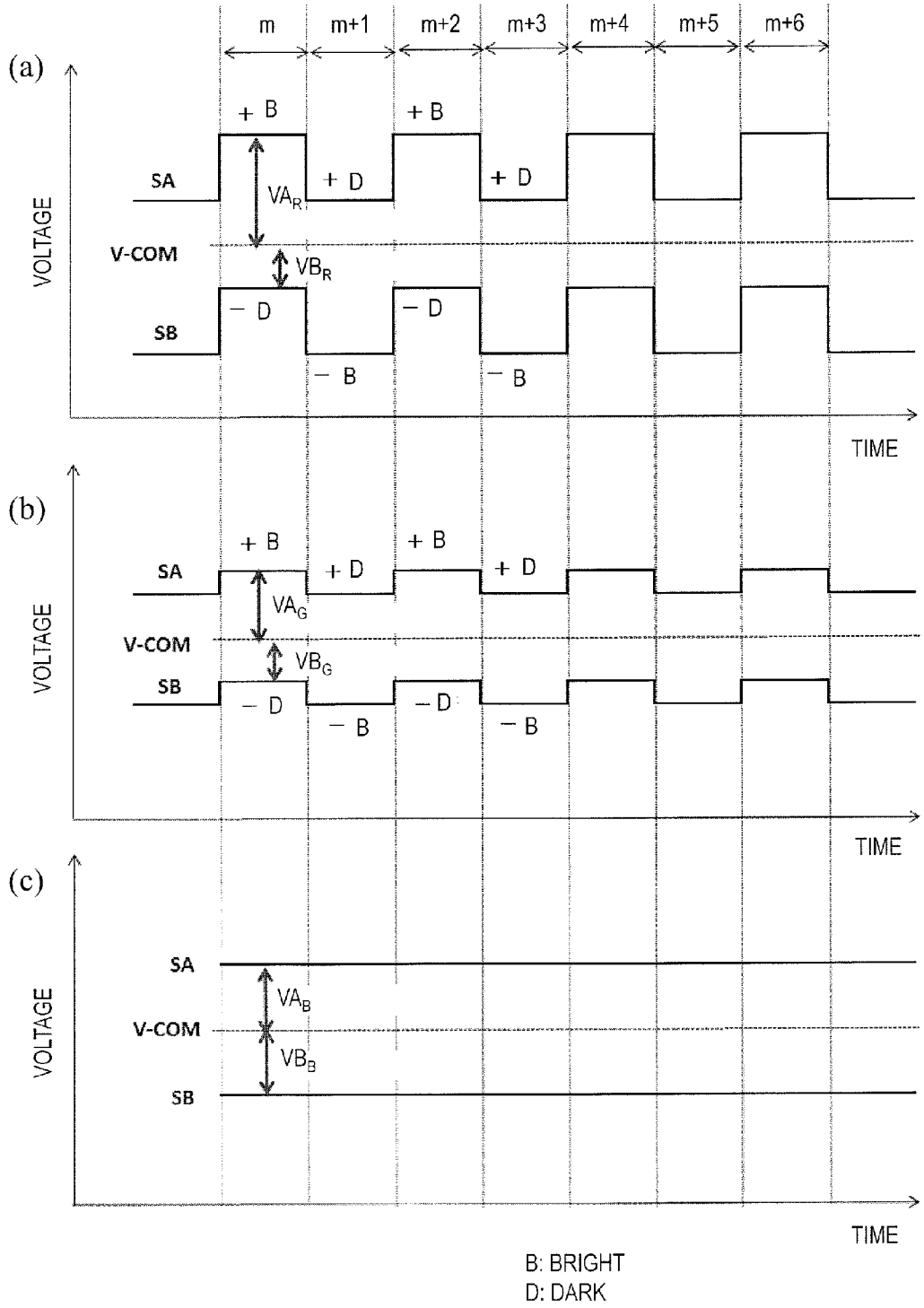
FIG. 8 (*a*) to (*c*) are charts showing examples of the waveforms of the first and second display signal voltages supplied to two sub-pixels included in R, G and B pixels, respectively.

FIGS. 8(*a*) to 8(*c*) show examples of the waveforms of the first and second display signal voltages supplied to two sub-pixels included in the R, G and B pixels.

In the liquid crystal display device 100 of the embodiment of the present invention, as described above, the first sub-pixel SP1 of each pixel P is supplied with the first display signal voltage from the first source bus line SA, and the second sub-pixel SP2 is supplied with the second display signal voltage from the second source bus line SB. The first display signal voltage and the second display signal voltage are supplied from the two source bus lines SA and SB that are electrically independent of each other and are therefore arbitrary voltages. Thus, the first display signal voltage and the second display signal voltage supplied to the first sub-pixel SP1 and the second sub-pixel SP2 of the R, G and B pixels which constitute one color display pixel can be freely set as shown in FIGS. 8(*a*) to 8(*c*).

Next, whether or not the viewing angle dependence of the color reproducibility can be reduced by determining the first and second display signal voltages for each of the pixels (e.g., the R, G and B pixels) is described with reference to FIG. 9 and FIG. 10.

Figure 9:
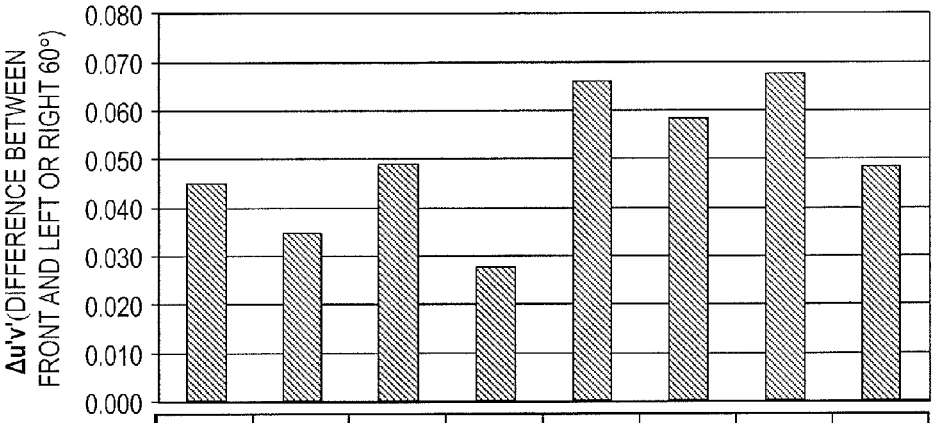
FIG. 9 A graph showing the relationship between the combinations of whether or not the multi-pixel driving is performed on R, G and B pixels and the viewing angle dependence of the color reproducibility in the case where the R, G and B pixels are used to exhibit a skin color.

FIG. 9 is a graph showing the relationship between the combinations of whether or not the multi-pixel driving is performed on R, G and B pixels and the viewing angle dependence of the color reproducibility in the case where a skin color is displayed using the R, G and B pixels.

Here, the skin color refers to such a color that, as described in Patent Document 2, the ranges of the grayscale level of the R, G and B pixels (from minimum to maximum) are from 105 to 255 for the R pixel, from 52 to 223 for the G pixel, and from 44 to 217 for the B pixel, and meanwhile, the grayscale levels of the three primary colors satisfy the relationship of R pixel>G pixel>B pixel. As for the color reproducibility of the display device, the memory colors are regarded as important. Since an image displayed on the display device cannot be directly compared with an actual object in almost all the cases, the relationship between the displayed image and an image in viewer's memory is important. For the display devices for television applications, the skin color is regarded as particularly important among the memory colors.

In the example shown in FIG. 9, a skin color is displayed of which the grayscale levels to be displayed by the R, G and B pixels are 88/255, 61/255 and 39/255. In FIG. 9, "A" shown under the horizontal axis means that "the multi-pixel driving is not performed". In this case, two sub-pixels exhibit the same grayscale level. "B" means that "the multi-pixel driving is performed". In this case, the grayscale level difference between the first sub-pixel and the second sub-pixel is set to the maximum. In FIG. 9, the vertical axis represents the value of the difference between a color perceived when viewed at the front viewing angle and a color perceived when viewed at the 60° oblique viewing angle (color difference), which is expressed by the distance (Δu'v') between the u'v' coordinates in the CIE1976 UCS chromaticity diagram.

As seen from FIG. 9, among the combinations of No. 1 to No. 8, the color difference of No. 4 where "the multi-pixel driving is not performed" on the R pixel while "the multi-pixel driving is performed" on the G pixel and the B pixel (which is the same as the example of FIG. 6) is less than 0.03, i.e., smaller than those of the other combinations.

In the case where the color display pixel includes m pixels, from the $1^{st}$ pixel to the $m^{th}$ pixel (m is an integer which is not less than 3), the grayscale levels which are to be exhibited by the $1^{st}$ pixel to the $m^{th}$ pixel are the $1^{st}$ grayscale level GL1 to the $m^{th}$ grayscale level GLm, respectively, and the $1^{st}$ grayscale level GL1 to the $m^{th}$ grayscale level GLm include at least two different grayscale levels, the control circuit 15 of an embodiment is configured to generate voltages which have equal absolute values as the first display signal voltage and the second display signal voltage respectively supplied to the first sub-pixel and the second sub-pixel of a pixel which is to exhibit a grayscale level of the largest value among the $1^{st}$ grayscale level GL1 to the $m^{th}$ grayscale level GLm. The thus-configured control circuit 15 can improve the viewing angle dependence of the color reproducibility of intermediate tones including the above-described skin color (exclusive of achromatic colors).

Figure 10:
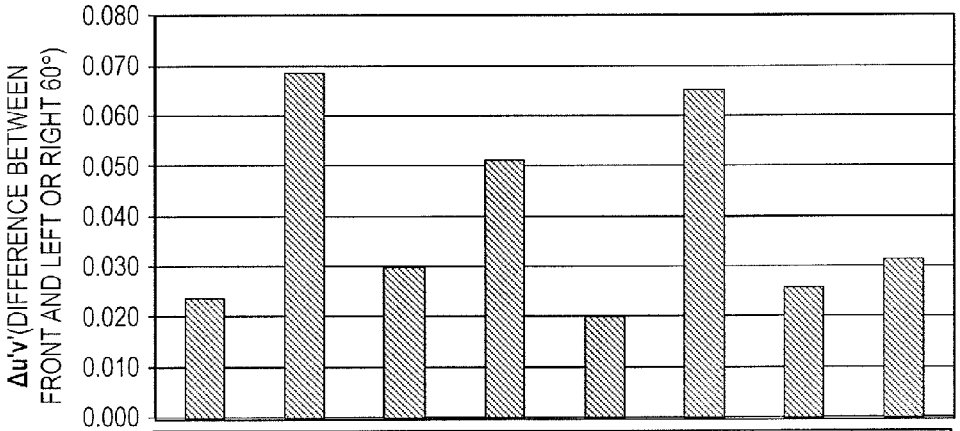
FIG. 10 A graph showing the relationship between the combinations of whether or not the multi-pixel driving is performed on R, G and B pixels and the viewing angle dependence of the color reproducibility in the case where the R, G and B pixels are used to exhibit an achromatic intermediate tone (gray).

FIG. 10 is a graph showing the relationship between the combinations of whether or not the multi-pixel driving is performed on R, G and B pixels and the viewing angle dependence of the color reproducibility in the case where the R, G and B pixels are used to exhibit an achromatic intermediate tone (gray). When the achromatic intermediate tone is colored, it gives a viewer a sense of incongruity, and therefore, suppressing coloring of the achromatic intermediate tone is important in terms of the color reproducibility.

In the example shown in FIG. 10, an achromatic intermediate tone is displayed of which the grayscale levels to be exhibited by the R, G and B pixels are 135/255, 135/255, and 135/255.

As seen from FIG. 10, among the combinations of No. 1 to No. 8, the color difference of No. 5 where "the multi-pixel driving is performed" on the R pixel while "the multi-pixel driving is not performed" on the G pixel and the B pixel is less than 0.02, i.e., smaller than those of the other combinations.

In the case where the color display pixel includes m pixels, from the $1^{st}$ pixel to the $m^{th}$ pixel (m is an integer which is not less than 3), including a blue pixel and a green pixel, the highest and lowest grayscale levels among the grayscale levels which are to be exhibited by the $1^{st}$ pixel to the $m^{th}$ pixel are GLmax and GLmin, respectively, and the value of GLmax/GLmin is in the range of not less than 0.95 and not more than 1.05, the control circuit 15 of an embodiment is configured to generate voltages which have equal absolute values as the first display signal voltage and the second display signal voltage supplied to the first sub-pixel and the second sub-pixel of the blue pixel and the green pixel. For example, when the value of GLmax/GLmin is in the range of not less than 0.95 and not more than 1.05, the color exhibited by the color display pixel is close to the achromatic intermediate tone, and therefore, the viewing angle dependence of the color reproducibility can be reduced by the above-described control circuit.

As described in the above example, it is preferred that the difference between the absolute values of the first display signal voltage and the second display signal voltage respectively supplied to the first sub-pixel and the second sub-pixel of a pixel on which "the multi-pixel driving is performed" is the maximum, although the present invention is not limited to this example. It may be appropriately changed according to the γ characteristic of the liquid crystal display panel.

Next, examples of the look-up table used for generation of display signal voltages which are to be supplied to two sub-pixels in the control circuit 15 are described with reference to FIG. 11 to FIG. 13.

FIG. 11 shows a look-up table used for, for example, the case previously described with reference to FIG. 9 where "the multi-pixel driving is not performed" on the R pixel which is to exhibit the highest grayscale level while "the multi-pixel driving is performed" on the G pixel and the B pixel.

For example, as shown in FIG. 11(*a*), when the R pixel is at the grayscale level of 0, the R pixel cannot be at the highest grayscale level. Therefore, a look-up table which is the same as a conventional one may be used. Note that numerical values are omitted from the drawing.

As shown in FIG. 11(*b*), for example, when the R pixel exhibits the grayscale level of 180/255, the G pixel exhibits the grayscale level of 120/255, and the B pixel exhibits the grayscale level of 80/255 (corresponding to a skin color), "the multi-pixel driving is not performed" on the R pixel and the R pixel exhibits the grayscale level of 180/255, while the grayscale level difference is given such that the maximum grayscale level difference is achieved in each of the G pixel and the B pixel.

When the R pixel exhibits the grayscale level of 255/255, numerical values are given to the look-up table shown in FIG. 11(*c*) such that the maximum grayscale level difference between sub-pixels is achieved in each of the G pixel and the B pixel at all the grayscale levels except for 0 and 255. Note that numerical values are omitted from the drawing.

A look-up table for a case where the pixel which is to exhibit the highest grayscale level is the G pixel and a look-up table for a case where the pixel which is to exhibit the highest grayscale level is the B pixel are prepared likewise as in FIG. 11 and are stored in, for example, a memory included in the primary color bright/dark division control circuits 22R, 22G and 22B shown in FIG. 1.

FIG. 12 shows another example of the look-up table used for generation of display signal voltages supplied to two sub-pixels in a liquid crystal display device of an embodiment of the present invention.

A look-up table in which combinations of output grayscale levels for each of the color pixels correspond to input grayscale levels as shown in FIG. 12 may also be used.

For example, when all of the R, G and B pixels exhibit the grayscale level of 135/255 as shown in FIG. 10, "the multi-pixel driving is performed" only on the R pixel.

In the case where a skin color is displayed such that the R, G and B pixels are at the grayscale levels of 180/255, 120/255 and 80/255, respectively, "the multi-pixel driving is not performed" on the R pixel while "the multi-pixel driving is performed" on the G pixel and the B pixel.

Although in the above-described example a single color display pixel consists of R, G and B pixels, the color display pixel may further include a Ye pixel (yellow pixel) as shown in FIG. 13. As a matter of course, the color display pixel may include a white pixel instead of the yellow pixel. Further, the color display pixel may include a red pixel, a green pixel, a blue pixel, a cyan pixel, a magenta pixel, and a yellow pixel. Numerical values which are to be inserted in blank boxes of FIG. 13 are set so as to satisfy the above-described conditions.

INDUSTRIAL APPLICABILITY

A liquid crystal display device of an embodiment of the present invention is applicable to a wide variety of uses in which the color reproducibility is demanded.

REFERENCE SIGNS LIST

10 liquid crystal display panel
15 control circuit
20 bright/dark division control circuit
22R, 22G, 22B primary color bright/dark division control circuit
100 liquid crystal display device

The invention claimed is:

1. A liquid crystal display device, comprising:

a plurality of pixels arranged in a matrix of rows and columns; and a control circuit configured to receive an input display signal that is indicative of a grayscale level which is to be exhibited by the plurality of pixels and supply a display signal voltage to each of the plurality of pixels, wherein the plurality of pixels form a plurality of color display pixels, each of the plurality of color display pixels including three or more pixels which exhibit different colors, each of the plurality of pixels includes a first sub-pixel electrically connected to a first source bus line via a first TFT and a second sub-pixel electrically connected to a second source bus line via a second TFT, and the control circuit is configured to generate a first display signal voltage and a second display signal voltage that are to be supplied to the first sub-pixel and the second sub-pixel of an arbitrary one of the plurality of pixels based on a grayscale level to be exhibited by the arbitrary pixel and grayscale levels to be exhibited by two or more remaining pixels included in a color display pixel to which the arbitrary pixel belongs that are indicated by the input display signal, and output the generated first and second display signal voltages to the first source bus line and the second source bus line, respectively.

2. The liquid crystal display device of claim 1, wherein for one grayscale level which is to be exhibited by the arbitrary pixel, the control circuit is capable of generating the first display signal voltage and the second display signal voltage that have two or more different absolute values according to the grayscale levels to be exhibited by the two or more remaining pixels.

3. The liquid crystal display device of claim 1, wherein an arbitrary one of the plurality of color display pixels includes m pixels, from a $1^{st}$ pixel to a $m^{th}$ pixel, where m is an integer which is not less than 3, grayscale levels which are to be exhibited by the $1^{st}$ pixel to the $m^{th}$ pixel are $1^{st}$ grayscale level GL1 to $m^{th}$ grayscale level GLm, luminances at a front viewing angle of the $1^{st}$ pixel to the $m^{th}$ pixel achieved when the $1^{st}$ pixel to the $m^{th}$ pixel exhibit the $1^{st}$ grayscale level GL1 to the $m^{th}$ grayscale level GLm which are normalized on the assumption that a luminance at the front viewing angle achieved when a highest grayscale level is exhibited is 1 are $1^{st}$ frontal normalized luminance NL1 to $m^{th}$ frontal normalized luminance NLm, respectively, luminances at an oblique 60° viewing angle of the $1^{st}$ pixel to the $m^{th}$ pixel which are normalized on the assumption that a luminance at the oblique 60° viewing angle achieved when a highest grayscale level is exhibited is 1 are $1^{st}$ oblique viewing angle normalized luminance IL1 to $m^{th}$ oblique viewing angle normalized luminance ILm, respectively, and the control circuit is configured to generate the first display signal voltage and the second display signal voltage that are to be supplied to the first sub-pixel and the second sub-pixel of each of the $1^{st}$ pixel to the $m^{th}$ pixel such that the maximum value of the difference between frontal luminance ratios between pixels which are obtained by normalizing the $1^{st}$ frontal normalized luminance NL1 to the $m^{th}$ frontal normalized luminance NLm with respect to a highest one of the $1^{st}$ frontal normalized luminance NL1 to the $m^{th}$ frontal normalized luminance NLm and oblique 60° luminance ratios between pixels which are obtained by normalizing the $1^{st}$ oblique viewing angle normalized luminance IL1 to the $m^{th}$ oblique viewing angle normalized luminance ILm with respect to a highest one of the $1^{st}$ oblique viewing angle normalized luminance IL1 to the $m^{th}$ oblique viewing angle normalized luminance ILm is not more than 0.25.

4. The liquid crystal display device of claim 1, wherein an arbitrary one of the plurality of color display pixels includes m pixels, from the $1^{st}$ pixel to the $m^{th}$ pixel, where m is an integer which is not less than 3, the grayscale levels which are to be exhibited by the $1^{st}$ pixel to the $m^{th}$ pixel are the $1^{st}$ grayscale level GL1 to the $m^{th}$ grayscale level GLm, respectively, the $1^{st}$ grayscale level GL1 to the $m^{th}$ grayscale level GLm include at least two different grayscale levels, and the control circuit is configured to generate voltages which have equal absolute values as the first display signal voltage and the second display signal voltage respectively supplied to the first sub-pixel and the second sub-pixel of a pixel which is to exhibit a grayscale level of a largest value among the $1^{st}$ grayscale level GL1 to the $m^{th}$ grayscale level GLm.

5. The liquid crystal display device of claim 4, wherein the control circuit is configured to generate the first display signal voltage and the second display signal voltage respectively supplied to the first sub-pixel and the second sub-pixel of each of the plurality of pixels exclusive of a pixel which exhibits a highest grayscale level among the m pixels included in the color display pixel such that a difference between the absolute values of the first display signal voltage and the second display signal voltage is a maximum.

6. The liquid crystal display device of claim 1, wherein the first source bus line and the second source bus line extend in the column direction, in each of the plurality of pixels, the first sub-pixel and the second sub-pixel are arranged in the column direction, and a polarity of the first display signal voltage supplied from the first source bus line and a polarity of the second display signal voltage supplied from the second source bus line are each constant within a frame.

7. The liquid crystal display device of claim 6, wherein the polarity of the first display signal voltage supplied from the first source bus line and the polarity of the second display signal voltage supplied from the second source bus line are opposite to each other in a frame.

8. The liquid crystal display device of claim 6, wherein some of the plurality of pixels which are arranged in the column direction are to exhibit a same color, and two sub-pixels which belong to two pixels adjacent to each other in the column direction and which are electrically connected to the first source bus line are adjacent to each other in the column direction.

9. The liquid crystal display device of claim 1, wherein each of the plurality of color display pixels includes a red pixel, a green pixel, and a blue pixel.

10. The liquid crystal display device of claim 9, wherein each of the plurality of color display pixels further includes a yellow pixel.

11. The liquid crystal display device of claim 1, wherein the first TFT and the second TFT include a semiconductor oxide layer as an active layer, the semiconductor oxide layer including an In—Ga—Zn—O semiconductor.

12. The liquid crystal display device of claim 11, wherein the In—Ga—Zn—O semiconductor includes a crystalline portion.

* * * * *